United States Patent [19]

Klages

[11] 4,182,248

[45] Jan. 8, 1980

[54] FABRIC PULLER

[76] Inventor: Arthur C. Klages, 1907 Huntington Rd., Greensboro, N.C. 27408

[21] Appl. No.: 822,688

[22] Filed: Aug. 8, 1977

[51] Int. Cl.[2] ..... D05B 21/00

[52] U.S. Cl. ..... 112/121.26; 112/322

[58] Field of Search ..... 64/15 R; 112/214, 211, 112/121.26, 121.27

[56] References Cited

U.S. PATENT DOCUMENTS

| | | | |
|---|---|---|---|
| 1,348,133 | 7/1920 | Thorne | 112/214 |
| 2,049,292 | 7/1936 | Feldmann | 112/214 |
| 2,170,948 | 8/1939 | Meyer | 112/214 |
| 2,263,414 | 12/1941 | Meyer | 112/214 |
| 2,863,411 | 12/1958 | Peets | 112/220 |
| 3,068,666 | 12/1962 | Sabadash | 64/15 R |
| 3,395,661 | 8/1968 | Creter | 112/220 |
| 3,408,882 | 11/1968 | Bialy | 112/220 |
| 3,960,097 | 6/1976 | Block | 112/214 |
| 4,065,043 | 12/1977 | Ohashi | 112/211 |

FOREIGN PATENT DOCUMENTS

| | | | |
|---|---|---|---|
| 1199625 | 12/1959 | France | 112/121.26 |

*Primary Examiner*—Ronald Feldbaum

[57] ABSTRACT

A fabric puller for removing a fabric from the sewing instrumentalities through a sewing machine at a predetermined rate of travel in which fabric-engaging rollers are resiliently urged toward one another to engage the fabric or separated to release the fabric and each roller is driven through a resilient coupling member from a variable speed drive mechanism.

1 Claim, 5 Drawing Figures

FABRIC PULLER

BACKGROUND AND ADVANTAGES OF THE INVENTION

Various types of fabric pullers have been employed in combination with sewing machines in which pairs of fabric-engaging rollers are employed but in which usually only one of the rollers is positively driven and there is no means for compensating for roller shaft offset when the rollers are displaced from fabric engagement.

Therefore, the fabric puller of the present invention overcomes the disadvantages of prior fabric pullers used in combination with sewing machines by driving each of the pair of fabric-engaging rollers which are resiliently urged into or out of fabric engagement and in which the fabric-engaging rollers are mounted on individual shafts which are bearingly rotated through a flexible connection to the drive mechanism for each shaft.

DETAILED DESCRIPTION OF THE PREFERRED EMBODIMENT OF THE INVENTION

Figure 1:
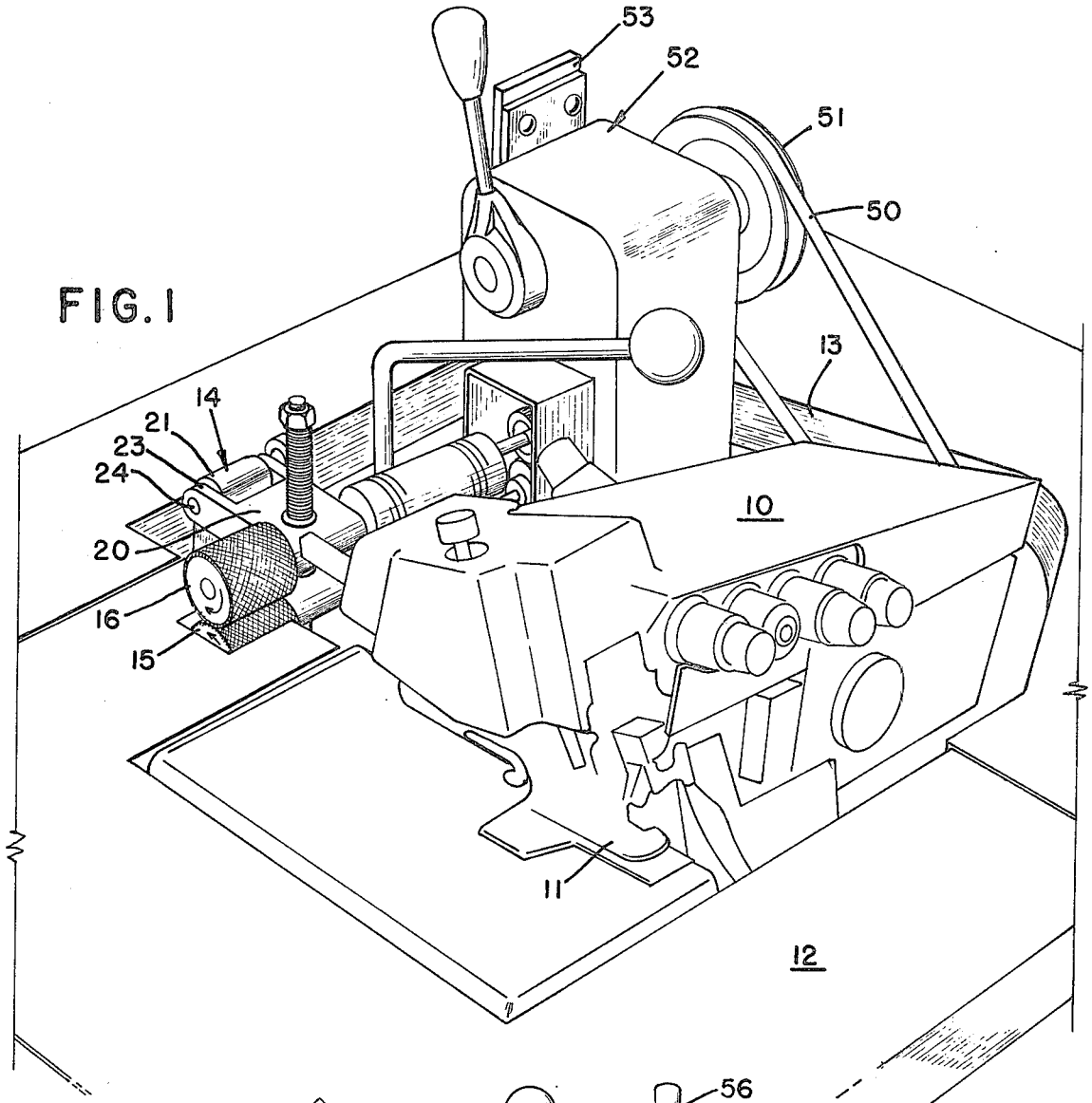
FIG. 1 is a perspective view of a fabric puller embodying this invention shown in combination and in operative relationship to an overedge sewing machine mounted on a table, only a portion of which is shown.

Referring to the drawings and particularly to FIG. 1, there is illustrated an overedge sewing machine 10 which has the conventional sewing instrumentalities (not shown) and presser foot 11 under which the fabric to be sewn is positioned by the operator with the fabric usually being draped over the sewing machine supporting table 12 which is provided with a suitable cut-out contour 13 to receive and support the sewing machine 10 at the proper position and level.

A fabric puller 14 is mounted on the sewing machine table 12 to the rear and in alignment with the sewing machine whereby fabric that is being sewn is engaged between the lower fabric-engaging roller 15 and the upper fabric-engaging roller 16 which rollers 15 and 16 are yieldably biased toward one another to grip and apply tension of the requisite amount, depending upon the type of fabric being sewn, as the fabric is being sewn. Each of the rollers 15 and 16 preferably has a knurled fabric-engaging surface, or some other suitable frictional surface for engaging the fabric to prevent slipping, as the rollers are rotated to withdraw the fabric at the desired linear velocity from the sewing instrumentalitites on the sewing machine.

Fabric-engaging roller 15 is securely fastened to the shaft 17 and roller 16 is securely fastened to shaft 18 which shafts 17 and 18 are bearingly supported in pivotable brackets 19 and 20, respectively, each of which is cantilever mounted to pivot on the vertical stanchion 21 that is secured to the flat base plate 22. The upper bracket 20 and the lower bracket 19 are each provided with a yoke 23 for straddling the stanchion 21 and for receiving therein a bracket supporting pivot rod 24. The yokes 23 for the upper and lower brackets 19 and 20 are each respectively secured to rods 24 that are vertically spaced from each other and transversely extend A vertical rod 25 is secured through the based 22 by a suitable fastening member (not shown) to retain the rod 25 in a vertical position and will pass through an opening 26 in the bracket 19 and an opening 27 in the bracket 20 with the upper end 28 of the rod 25 being encircled by a helical compression spring member 29 which may be adjusted to apply the desired tension on a fabric through compression of the rollers 15 and 16 by means of the rotatable nut 30 mounted on the threaded section 31 on the upper end 28 of the rod 25. The lower end 32 of the spring will urge the bracket member 20 downwardly in a clockwise direction about the rod 24, as shown in FIG. 3.

Figure 4:
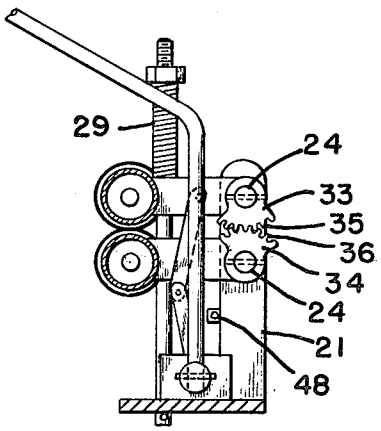
FIG. 4 is a partial transverse sectional view taken substantially along the line 4—4 of FIG. 2.
Figure 3:
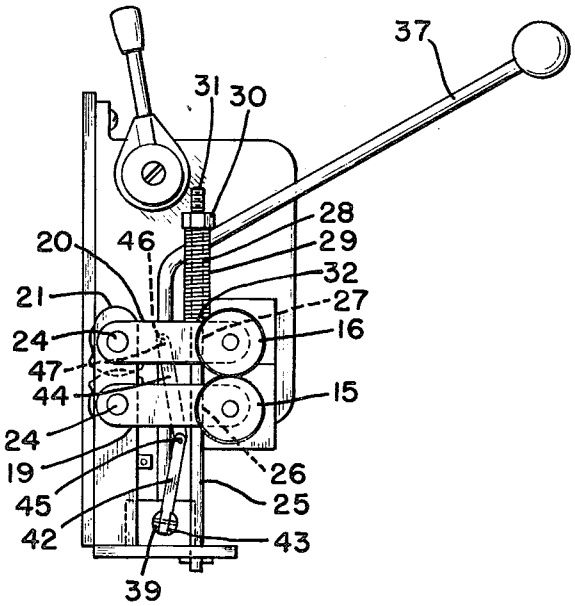
FIG. 3 is a left end elevational view of FIG. 2.

There is illustrated in FIG. 4, a side opposite from that shown in FIG. 3 a position in which each of the rods is rotatably supported in the stanchion 21 and in interlocking engagement by the meshing gear segments 33 and 34 each of which is releasably locked to its respective rod 24 with the teeth 35 on gear segment 33 intermeshing with certain of the gear teeth on the gear segment 34.

Figure 2:
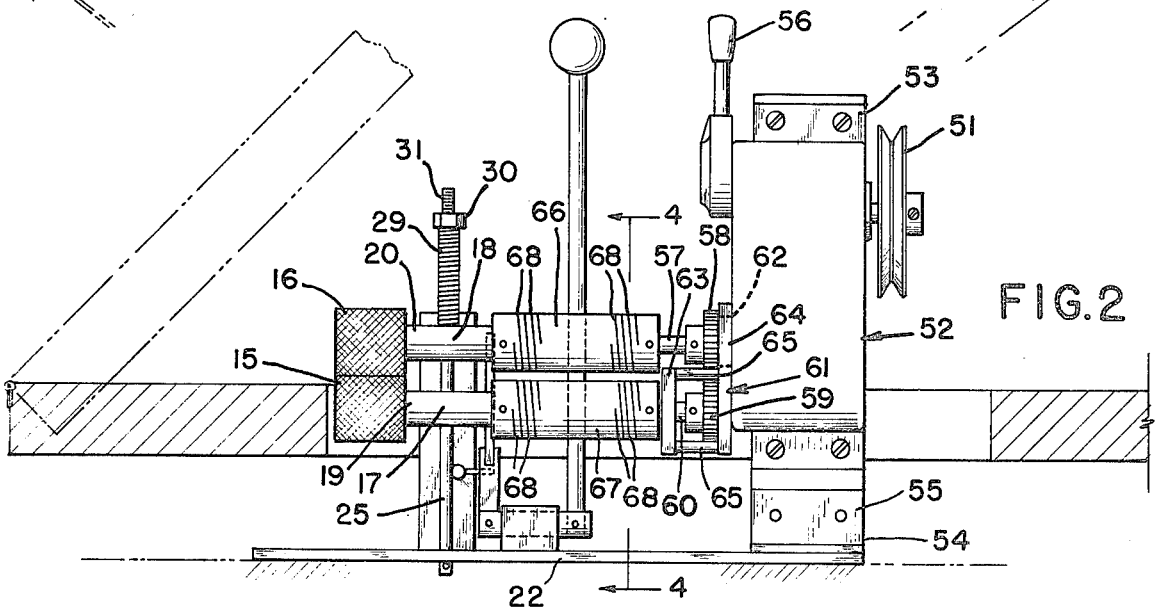
FIG. 2 is a front elevational view of the fabric puller with a drive shaft gear reducing mecahanism illustrating the fabric-engaging rollers in contact with each other in the operative position.
Figure 5:
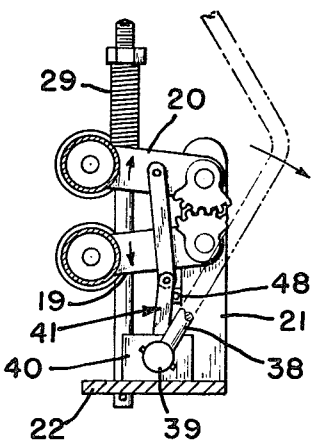
FIG. 5 is a view similar to FIG. 4 with the fabric engaging rollers and the coupling means separated to the inoperative position upon rotation of the disengaging crank arm.

A crank handle 37, for positioning the fabric-engaging rollers 15 and 16 into and out of engagement, is secured at its lower end 38 to the rotatable shaft 39 that is rotatably supported in the block 40 that is securely mounted to the base plate 22 of the puller as shown in FIGS. 2, 4 and 5. A toggle linkage 41 has its lower link 42 secured to the opposite side 43 of the shaft 39 for displacement therewith. The upper link 44 of the toggle mechanism 41 is connected at the pivot pin 45 to the lower link 42 with the upper end 46 of the upper link 44 being connected by the pivot pin 47 to the upper bracket member 20. A limit stop 48 secured to the stanchion 21 extends to engage and limit displacement of the lower link 42 when the crank handle 37 is rotated in a clockwise direction, as shown in FIG. 5, to separate the brackets 19 and 20 from each other which in turn will separate or part the rollers 15 and 16 from each other with the upper bracket 20 compressing the helical spring 29. In the position illustrated in FIG. 5, the toggle mechanism 41 will be maintained beyond dead center and the rollers will be retained in the parted or separated condition shown in FIG. 5 until the crank handle 37 is rotated in a counterclockwise direction which will pivot the toggle mechanism 41 and the bottom link 42 in a counterclockwise direction as shown in FIG. 4 enabling the gear segments 33 and 34 to rotate and position the brackets 19 and 20 into closer relationship through the rsilient action of the compression spring 29.

A driving belt 50 is mounted and driven from the sewing machine driving pulley (not shown) and is connected to the driven pulley 51 that is mounted on the gear reducing mechanism 52 that is supported on the vertical bracket 53 which is fastened at its base 54 to the angle bracket member 55 which in turn is secured to the base plate 22. The gear reducer mechanism may be of any conventional type such as manufactured and sold by Zero-Max of Minneapolis, Minnesota, Model E2. The speed of the gear reducer may be varied for the output drive by the speed control handle 56 rotatably mounted on the speed reducing mechanism 52.

The stub driving shaft 57 from the gear reducer 52 has a gear 58 keyed to rotate therewith and intermesh with gear 59 that is mounted on the stub shaft 60 which is supported to rotate in a bearing (not shown) in the supporting cage 61 which is suspended and retained on a projecting boss 62 which extends from the reducing mechanism housing 52 about the shaft 57. Cage 61 is secured by suitable set screws (not shown) to the boss 62 and is provided with a spaced guide and bearing supporting plate 63 that is securely mounted in spaced relation to the plate 64 by means of spacer elements 65 to retain the shaft 60 in fixed parallel relationship to shaft 57.

Stub shaft 57 is connected to shaft 18 for the top fabric-engaging roller 16 by means of the cylindrical resilient coupling 66 which is secured to the ends of each of said shafts 18 and 57 by suitable fastening means. The stub shaft 60 and shaft 17 connected to the bottom fabric-engaging roller 15 are connected together by the resilient cylindrical coupling 67 by suitable fastening means. Each of the coupling members 66 and 67 is provided with a series of helical spring-like convolutions 68 in spaced axial positions on the couplings 66 and 67 to permit deflection of the coupling members 66 and 67 as the fabric-engaging rollers 15 and 16 are separated from each other. The coupling members 66 and 67 may be of the type marketed under the trademark "HELI-CAL" sold by Helical Products Company, Inc. of Redondo Beach, Calif.

During normal operation, the coupling members 66 and 67 will be in alignment axially with the stub shaft 57 and shaft 18 as well as axial alignment for the coupling 67 will occur with stub shaft 60 and shaft 17, as shown in FIG. 2. However, when the fabric-engaging rollers 15 and 16 are separated by rotation of the crank handle 37 in the position shown in FIG. 5, the coupling members 66 and 67 will be deflected out of alignment and retained in that position until the toggle mechanism is returned to the position shown in FIGS. 3 and 4 without separation.

In operation, the driving belt 50 will rotate the pulley 51 which in turn will actuate the gear reducer 52 and the outlet stub shaft 57 will rotate gear 58 which meshes to drive gear 59 so that shafts 57 and 60 will be driven at the same angular velocity to transmit the same rate of rotation through the coupling members 66 and 67 to the shafts 17 and 18 which will rotate the fabric-engaging rollers 15 and 16 which may be spaced apart to apply the appropriate tension to the fabric being withdrawn from the sewing instrumentalities on the sewing machine 10 depending upon the fabric thickness and weight.

I claim:

1. A fabric puller for use in combination with a sewing machine having instrumentalities for sewing a fabric comprising; a pair of fabric-engaging rollers rotatably mounted in biased parallel alignment with said sewing machine instrumentalities, each of said rollers having a shaft, means for urging said rollers toward each other to engage and apply a pulling force on said fabric, said urging means including a stanchion, a pair of vertically spaced apart roller shaft supporting brackets, each of said brackets being pivotably mounted in a cantilever manner to said stanchion, intermeshing cooperating gear means connected to said supporting brackets, resilient means urging said brackets to pivot toward each other to engage and apply tension to said fabric as said fabric is pulled from said sewing instrumentalities of said sewing machine by the rotation of a rotating crank-operated toggle means connected to one of said brackets, means for separating said fabric-engaging rollers from engagement with the fabric positioned therebetween, means for driving each of said roller shafts at predetermined speeds, and a coupling means for each roller shaft connecting said roller shaft to its driving means and supporting and resiliently urging said fabric-engaging rollers into parallel alignment when separated, said coupling means including, for each shaft, a cylindrical helical member for connecting said shaft to the shaft driving means, said driving means including a variable speed gear reducing mechanism whereby the rotation of each of said fabric engaging rollers will rotate at a predetermined angular velocity to control the linear travel of the fabric through the sewing machine instrumentalities.

* * * * *